US010861370B2

(12) United States Patent
Liu et al.

(10) Patent No.: US 10,861,370 B2
(45) Date of Patent: Dec. 8, 2020

(54) DRIVING CIRCUIT AND DRIVING METHOD FOR A DISPLAY PANEL, AND DISPLAY DEVICE

(71) Applicant: Xiamen Tianma Micro-Electronics Co., Ltd., Xiamen (CN)

(72) Inventors: Bingping Liu, Xiamen (CN); Zhenqing Xie, Xiamen (CN); Guozhao Chen, Xiamen (CN)

(73) Assignee: Xiamen Tianma Micro-Electronics Co., Ltd., Xiamen (CN)

( * ) Notice: Subject to any disclaimer, the term of this patent is extended or adjusted under 35 U.S.C. 154(b) by 0 days.

(21) Appl. No.: 16/392,629

(22) Filed: Apr. 24, 2019

(65) Prior Publication Data

US 2019/0259324 A1 Aug. 22, 2019

(30) Foreign Application Priority Data

Dec. 28, 2018 (CN) ..... 2018 1 1629051

(51) Int. Cl.
*G09G 3/20* (2006.01)

(52) U.S. Cl.
CPC ... *G09G 3/2003* (2013.01); *G09G 2300/0452* (2013.01); *G09G 2300/0804* (2013.01); *G09G 2310/0297* (2013.01); *G09G 2330/021* (2013.01)

(58) Field of Classification Search
CPC ..... G09G 3/2003; G09G 3/3648
USPC ..... 345/87, 690, 691
See application file for complete search history.

(56) References Cited

U.S. PATENT DOCUMENTS

| | | | | |
|---|---|---|---|---|
| 8,134,535 | B2 * | 3/2012 | Choi | G06F 3/044 345/173 |
| 9,785,286 | B2 * | 10/2017 | Cao | G06F 3/0443 |
| 2019/0096344 | A1 * | 3/2019 | Zuo | G09G 3/3648 |
| 2019/0121476 | A1 * | 4/2019 | Jang | G09G 3/20 |
| 2019/0155430 | A1 * | 5/2019 | Hwang | G06F 3/044 |
| 2019/0371257 | A1 * | 12/2019 | Zuo | G02F 1/136213 |

FOREIGN PATENT DOCUMENTS

| | | |
|---|---|---|
| CN | 101989542 A | 3/2011 |
| CN | 105609079 A | 5/2016 |
| CN | 106531096 A | 3/2017 |
| CN | 107195629 A | 9/2017 |

* cited by examiner

*Primary Examiner* — Calvin C Ma
(74) *Attorney, Agent, or Firm* — Kilpatrick Townsend & Stockton, LLP

(57) ABSTRACT

Provided are a driving circuit and driving method for a display panel, and a display device. The driving method of a display panel includes that: the display panel includes a base substrate, a plurality of data lines and a plurality of scanlines; the plurality of data lines and the plurality of scanlines intersect to define a plurality of sub-pixels; each of pixel units is formed by adjacent N sub-pixels, a data line group is formed by every X data lines of the plurality of data lines connected to M columns of the pixel units, and the data line group is connected to a data signal output line through a multiplexer; the method further includes: controlling, through the multiplexer, data lines in a same data line group and corresponding to sub-pixels of a same color to continuously input data signals.

13 Claims, 15 Drawing Sheets

--Piror Art--

DRIVING CIRCUIT AND DRIVING METHOD FOR A DISPLAY PANEL, AND DISPLAY DEVICE

CROSS-REFERENCES TO RELATED APPLICATIONS

This application claims priority to a Chinese patent application No. 201811629051.5 filed on Dec. 28, 2018, disclosure of which is incorporated herein by reference in its entirety.

FIELD

The present disclosure relates to the field of display techniques and, in particular, to a driving circuit and driving method for a display panel, and a display device.

BACKGROUND

A display panel includes a plurality of pixel units arranged in an array, and each pixel unit generally includes three sub-pixels of different colors. The display panel is configured with a plurality of data lines parallel to each other and a plurality of gate lines parallel to each other and intersected with the data lines. The sub-pixels are arranged at intersections of the plurality of data lines and the plurality of gate lines, so each sub-pixel is controlled by one gate scanline and one data line. The gate lines are configured to control the turning on and turning off of the sub-pixels, and the data lines apply different data voltage signals to the sub-pixels, so that the sub-pixels display different gray scales, and thereby a full-color picture is displayed.

As the resolution of the display panel increases, the number of source lines needed for outputting data voltage signals is increasing. At present, each column of data lines is charged in a manner of time division multiplexing by employing switching of multiplexer (MUX) to reduce the number of source lines. If one source line corresponds to three sub-pixels, the data signal is periodically outputted to each sub-pixel one by one through a 1:3 multiplexer, so that the source line charges the corresponding sub-pixel. If one source line corresponds to six sub-pixels, the data signal is periodically outputted to each sub-pixel one by one through a 1:6 multiplexer, so that the source line charges the corresponding sub-pixel.

Each pixel unit may include three sub-pixels of different colors. If three sub-pixels of the pixel unit are sequentially charged, the data voltage signals outputted by the source line are sequentially inverted, and power consumption of the driving circuit of the display panel is large.

SUMMARY

The embodiments of the present disclosure provide a driving circuit and driving method for a display panel, and a display device, for solving the problem that power consumption of the display panel driving circuit is large.

One embodiment of the present disclosure provides a driving method for a display panel. The display panel includes a base substrate, a plurality of data lines and a plurality of scanlines. The plurality of data lines and the plurality of scanlines intersect to define a plurality of sub-pixels. Each of pixel units is formed by adjacent N sub-pixels, a data line group is formed by every X data lines of the plurality of data lines connected to M columns of the pixel units, and the data line group is connected to a data signal output line through a multiplexer. X=M*N, N is a positive integer greater than or equal to 3, and M is a positive integer greater than or equal to 2. The N sub-pixels in one of the pixel units include a plurality of sub-pixels of different colors. The method further includes:

controlling, through the multiplexer, data lines in a same data line group and corresponding to sub-pixels of a same color to continuously input data signals.

One embodiment of the present disclosure provides a display panel driving circuit. The display panel driving circuit is applicable to the driving method for a display panel provided in any embodiment of the present disclosure. The display panel includes a plurality of data lines and a plurality of scanlines. The plurality of data lines and the plurality of scanlines intersect to define a plurality of sub-pixels. Each of pixel units is formed by adjacent N sub-pixels, a data line group is formed by every X data lines of the plurality of data lines connected to M columns of the pixel units, and the display panel driving circuit includes a multiplexer. The data line group is connected to a data signal output line through the multiplexer. X=M*N, N is a positive integer greater than or equal to 3, and M is a positive integer greater than or equal to 2. The N sub-pixels in one of the pixel units include a plurality of sub-pixels of different colors.

The display panel driving circuit is configured to control, through the multiplexer, data lines in a same data line group and corresponding to sub-pixels of a same color to continuously input data signals.

One embodiment of the present disclosure further provides a display device. The display device includes the display panel driving circuit provided in any one of the embodiments of the present disclosure.

In the present disclosure, the base substrate of the display panel is configured with a plurality of sub-pixels defined by intersection of the plurality of data lines and the plurality of scanlines. Each of pixel units is formed by adjacent N sub-pixels. A data line group is formed by every X data lines of the plurality of data lines connected to M columns of the pixel units. The data line group is connected to a data signal output line through a 1:X multiplexer. The N sub-pixels in one of the pixel units include a plurality of sub-pixels of different colors. When the display panel is driven, data lines in a same data line group and corresponding to sub-pixels of a same color are controlled to continuously input data signals through the multiplexer. The difference in amplitude of data signals inputted to the sub-pixels of the same color is small. A continuous input of data signals to the sub-pixels of the same color can effectively reduce the voltage amplitude variation of the data signals outputted by the data signal output lines, and reduce the power consumption of the display panel driving circuit.

DETAILED DESCRIPTION

Figure 1:
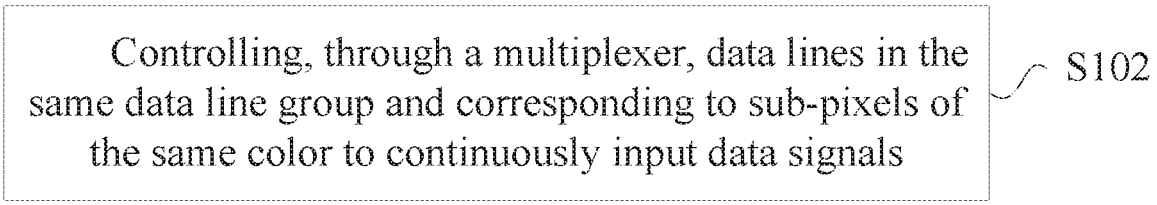
FIG. 1 is a flowchart of a driving method for a display panel according to an embodiment of the present disclosure.

Hereinafter the present disclosure will be further described in detail in conjunction with the drawings and embodiments. It should be understood that the embodiments set forth below are merely intended to illustrate and not to limit the present disclosure. Additionally, it should be noted that, for ease of description, only part, not all, of the structures related to the present disclosure are illustrated in the drawings.

In a related art, when a data signal is inputted to a data line through a multiplexer and in condition that each pixel unit includes three sub-pixels of a red sub-pixel, a blue sub-pixel, and a green sub-pixel, the sub-pixels in each pixel unit can be periodically illuminated one by one through the 1:3 multiplexer and each row of pixel units is correspondingly provided with one multiplexer. In one embodiment, when the scanline scans a row of pixel units in the display panel, data signals are controlled, through each multiplexer, to be sequentially inputted into the red sub-pixel, the green sub-pixel, and the blue sub-pixel of the pixel units in the row.

If the data signal is input to the data line through a 1:6 multiplexer, the sub-pixels of the two pixel units are periodically illuminated one by one through the 1:6 multiplexer, for further reducing the number of data signal output lines of the source driver. Each two columns of pixel units are correspondingly provided with one multiplexer. When the scanline scans a row of pixel units in the display panel, data signals are sequentially inputted, through each multiplexer, into the sub-pixels of the two pixel units in the row, specifically in a sequence of the red sub-pixel, the green sub-pixel, the blue sub-pixel, the red sub-pixel, the green sub-pixel, and the blue sub-pixel.

In the process of implementing the solutions in the embodiments of the present disclosure, the inventor finds that when the display panel is driven, the red sub-pixel, the green sub-pixel, and the blue sub-pixel are illuminated one by one whether through the 1:3 multiplexer or through the 1:6 multiplexer, and that the voltage amplitudes of the data signals inputted to sub-pixels of different colors are quite different. For example, if a voltage value of the data signal required by the red sub-pixel is about 5V and a voltage value of the data signal required by the green sub-pixel is about 2V, the data signal output line outputs, through the multiplexer, a data signal with a voltage value of 5V to the red sub-pixel and then a data signal with a voltage value of 2V to the green sub-pixel, and subsequently outputs the data signals for the blue sub-pixel and the red sub-pixel. Then, the data signal outputted by the data signal output line continuously has a large voltage amplitude change, that is, the number of times of inversion of the data signal is large, and the power consumption of the display panel driving circuit is large.

Therefore, an embodiment of the present disclosure provides a driving method for a display panel. Referring to FIG. 1, FIG. 1 is a flowchart of the driving method for a display panel according to the embodiment of the present disclosure. The display panel 1 includes a base substrate, a plurality of data lines and a plurality of scanlines. The plurality of data lines and the plurality of scanlines intersect to define a plurality of sub-pixels. Each of pixel units is formed by adjacent N sub-pixels, a data line group is formed by every X data lines of the plurality of data lines connected to M columns of the pixel units, and the data line group is connected to a data signal output line through a multiplexer. X=M*N, N is a positive integer greater than or equal to 3, and M is a positive integer greater than or equal to 2. The N sub-pixels in one of the pixel units include a plurality of sub-pixels of different colors. As shown in FIG. 1, the method further includes a step described below.

In S101, data lines in the same data line group and corresponding to sub-pixels of the same color are controlled, through the multiplexer, to continuously input data signals.

In the driving method for a display panel provided in the embodiment of the present disclosure, the base substrate of the display panel is provided with a plurality of sub-pixels defined by intersection of the plurality of data lines and the plurality of scanlines. Each of pixel units is formed by adjacent N sub-pixels. A data line group is formed by every X data lines of the plurality of data lines connected to M columns of the pixel units. The data line group is connected to a data signal output line through a 1:X multiplexer. The N sub-pixels in one of the pixel units include a plurality of sub-pixels of different colors. When the display panel is driven, data lines in the same data line group and corresponding to sub-pixels of a same color are controlled to continuously input data signals through the multiplexer. The difference in voltage amplitude of data signals inputted to the sub-pixels of the same color is small. A continuous input of data signals to the sub-pixels of the same color can effectively reduce the voltage amplitude variation of the data signals outputted by the data signal output lines, and reduce the power consumption of the display panel driving circuit.

Figure 2:
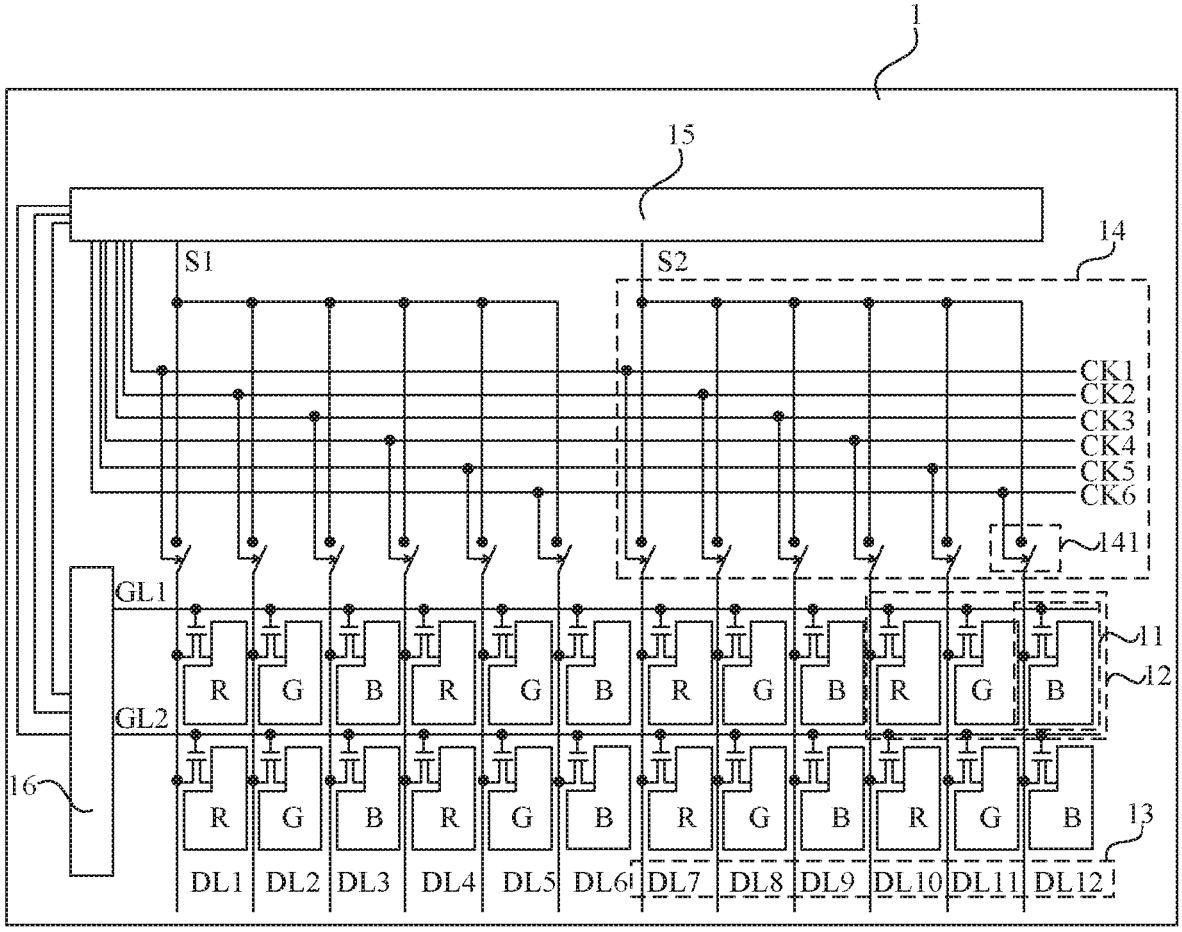
FIG. 2 is a structural diagram of a driving circuit of the display panel according to an embodiment of the present disclosure.

Referring to FIG. 2, FIG. 2 is a structural diagram of a driving circuit of the display panel according to an embodiment of the present disclosure. In the embodiment, the display panel driving method is described by taking the driving circuit of the display panel shown in FIG. 2 as an example. The base substrate 1 of the display panel is formed with a plurality of intersected data lines and scanlines, such as scanlines GL1 and GL2 and data lines DL1 to DL12. The plurality of data lines and the plurality of scanlines intersect to define a plurality of sub-pixels 11. A pixel unit 12 is formed by adjacent N sub-pixels 11, a data line group 13 is formed by every X data lines of the plurality of data lines connected to M columns of the pixel units. Exemplarily, as shown in FIG. 2, each column of pixel units may include three data lines. If the value of M is 2, the data line group 13 formed by two columns of pixel units includes six data lines, such as data lines DL1 to DL6, or data lines DL7 to DL12. Each data line group 13 is connected to a data signal output line through a multiplexer 14. For example, a data line group 13 formed by the data lines DL1 to DL6 is connected to a data signal output line S1 through a multiplexer 14, and a data line group 13 formed by the data lines DL7 to DL12 is connected to a data signal output line S2 through another multiplexer 14. In the embodiment, the scan signal may be outputted to each scanline row by row by a gate driver 16, and a source driver 15 outputs the data signals to the data lines of the data line group 13 through the respective data signal output line.

The N sub-pixels in one of the pixel units include a plurality of sub-pixels of different colors. Exemplarily, as shown in FIG. 2, each pixel unit 12 may include three sub-pixels, respectively a red sub-pixel, a blue sub-pixel and a green sub-pixel. When the N data lines of the data line group 13 in one-to-one correspondence with the multiplexer 14 are controlled through the multiplexer 14 to input the data signals one by one, data lines of sub-pixels 11 of the same color continuously input the data signals. Referring to FIG. 2, in the data line group 13 formed by the data lines DL1 to DL6, data lines corresponding to the red sub-pixels are continuously inputted data signals, data lines corresponding to the blue sub-pixels are continuously inputted data signals, and data lines corresponding to the green sub-pixels are continuously inputted data signals. For example, for data lines DL1 to DL6, data lines DL1 and DL4 are continuously inputted data signals, data lines DL2 and DL5 are continuously inputted data signals, and data lines DL3 and DL6 data signals are continuously inputted data signals.

Figure 3:
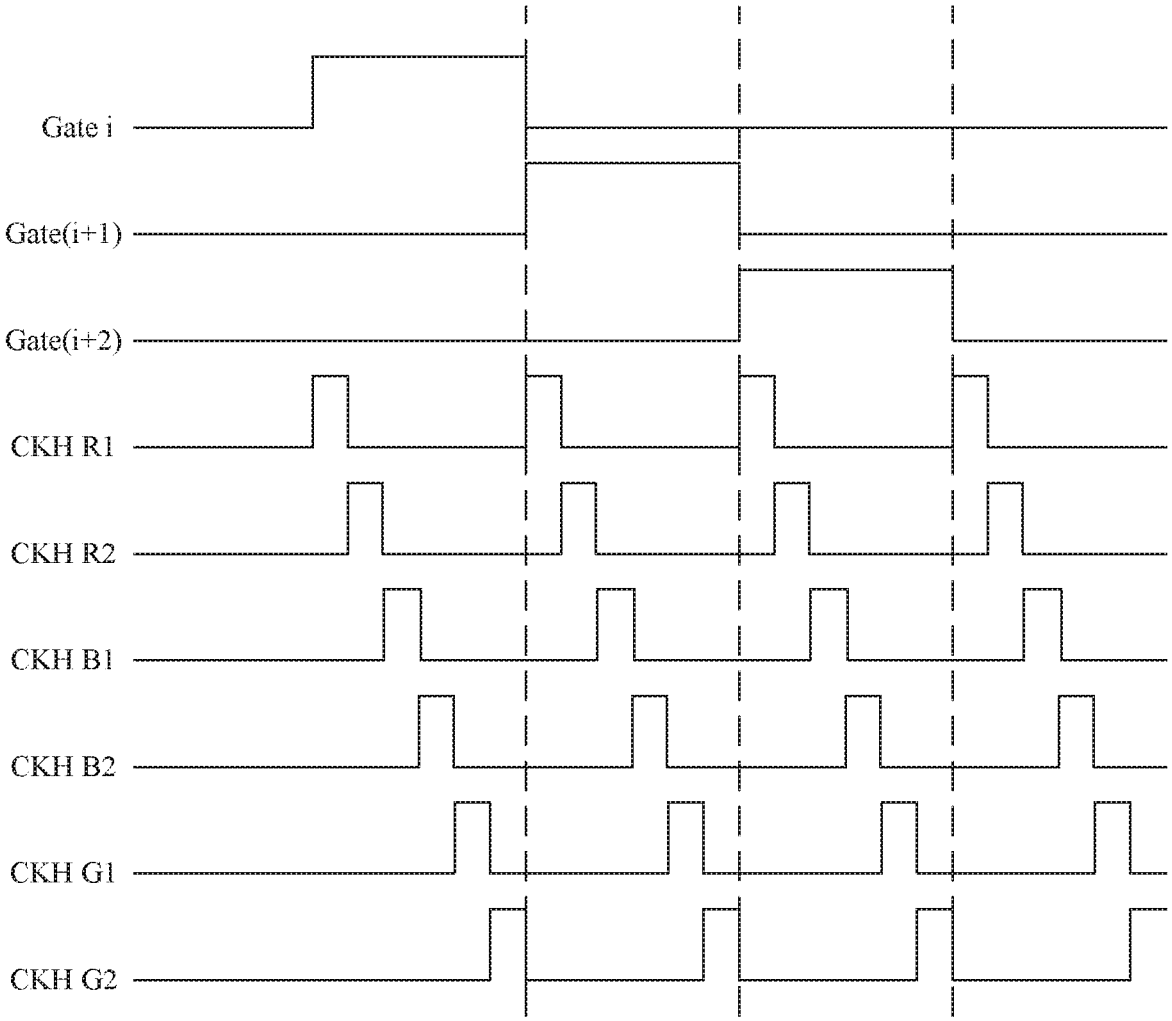
FIG. 3 is a timing diagram of scan signals and clock control signals of the display panel according to an embodiment of the present disclosure.

Whether a data line is inputted a data signal depends on the clock control signal which controls the multiplexer. Exemplarily, referring to FIG. 2, the 1:6 multiplexer connected to the data lines DL1 to DL6 can be controlled by six clock control signals to select one data line to input the data signal. As shown in FIG. 3, FIG. 3 is a timing diagram of scan signals and clock control signals of the display panel according to an embodiment of the present disclosure. If the pixel unit includes the red sub-pixel, the blue sub-pixel and the green sub-pixel, a data line group is formed by six data lines DL1 to DL6 in the adjacent two columns of pixel units, and six clock control signals are respectively a red sub-pixel clock control signal CKH R1, a red sub-pixel clock control signal CKH R2, a blue sub-pixel clock control signal CKH B1, a blue sub-pixel clock control signal CKH B2, a green sub-pixel clock control signal CKH G1 and a green sub-pixel clock control signal CKH G2. It is assumed that a scanline signal of the ith row of pixel units is Gate i, that a scanline signal of the (i+1)th row of pixel units is Gate (i+1), and that a scanline signal of the (i+2)th row of pixel units is Gate (i+2). In condition that the data signals are inputted in to the sub-pixels in a sequence of a red sub-pixel, a blue sub-pixel and a green sub-pixel, as shown in FIG. 3, in a scanning process of each row of the scan signals, a logic enable pulse signal is formed sequentially by the red sub-pixel clock control signal CKH R1, the red sub-pixel clock control signal CKH R2, the blue sub-pixel clock control signal CKH B1, the blue sub-pixel clock control signal CKH B2, the green sub-pixel clock control signal CKH G1 and the green sub-pixel clock control signal CKH G2. Then the data signals are inputted to the data lines DL1 to DL6 in a sequence of DL1, DL4, DL3, DL6, DL2 and DL5.

Figure 4:
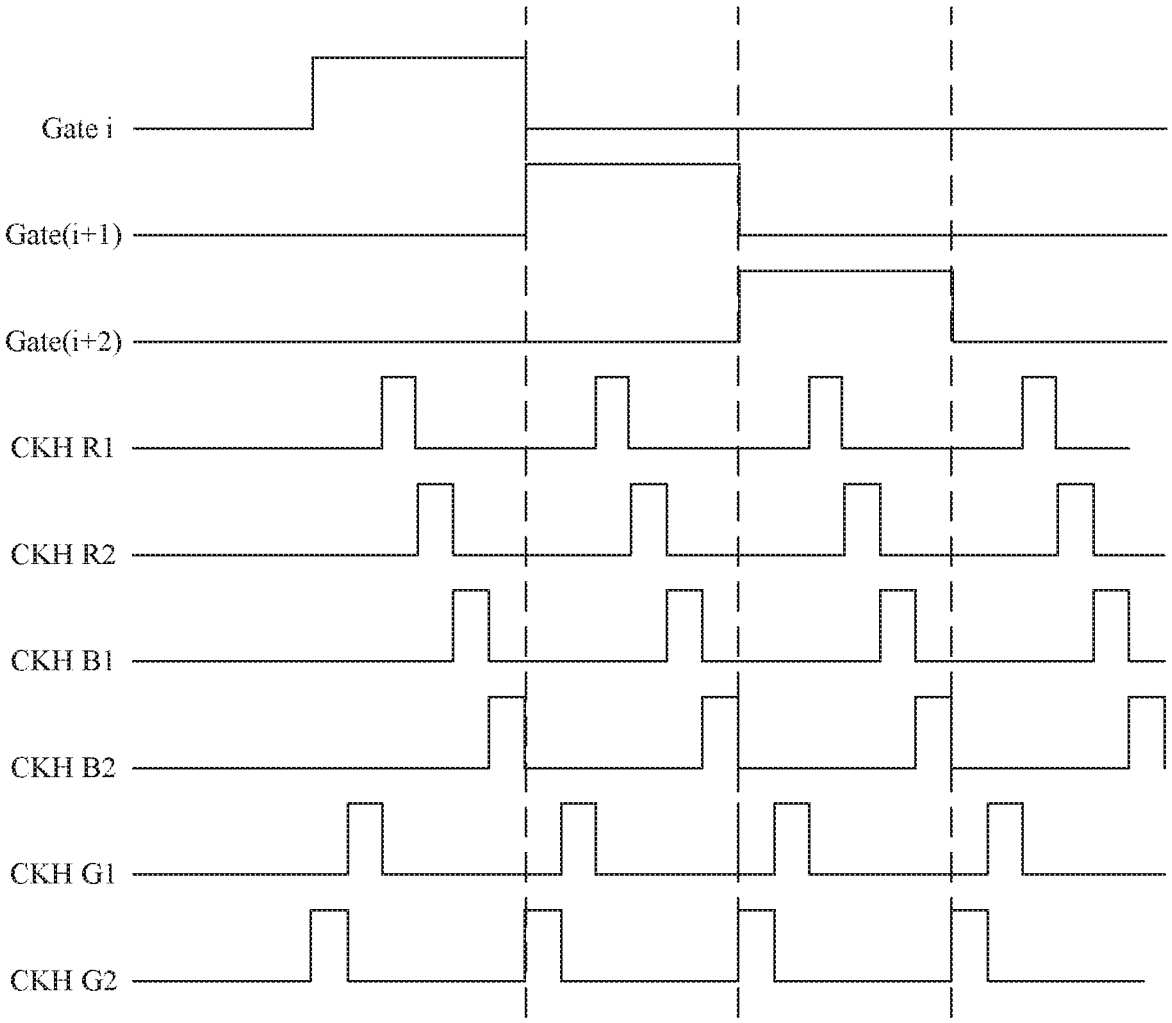
FIG. 4 is another timing diagram of scan signals and clock control signals of the display panel according to an embodiment of the present disclosure.

It is assumed that the data signals are inputted to the sub-pixels in a sequence of the green sub-pixel, the red sub-pixel and the blue sub-pixel. As shown in FIG. 4, FIG. 4 is another timing diagram of scan signals and clock control signals of the display panel according to an embodiment of the present disclosure. In a scanning process of each row of the scan signals, a logic enable pulse signal is formed sequentially by the green sub-pixel clock control signal CKH G1, the green sub-pixel clock control signal CKH G2, the red sub-pixel clock control signal CKH R1, the red sub-pixel clock control signal CKH R2, the blue sub-pixel clock control signal CKH B1 and the blue sub-pixel clock control signal CKH B2. Then the data signals are inputted to the data lines DL1 to DL6 in a sequence of DL2, DL5, DL1, DL4, DL3 and DL6.

In addition, the data signals may also be inputted to the sub-pixels in a sequence of the red sub-pixel, the green sub-pixel, and the blue sub-pixel, and then the data signals are inputted by the data lines DL1 to DL6 in a sequence of DL1, DL4, DL2, DL5, DL3 and DL6.

In one embodiment, still referring to FIG. 2, the multiplexer 14 of the display panel includes X switching element groups 141 in one-to-one correspondence with the X data lines, and each of the X switching element groups 141 includes a control terminal, an input terminal, and an output terminal. The display panel further includes X clock control signal line groups, and control terminals of the X switching element groups 141 of the multiplexer 14 are connected in one-to-one correspondence to the X clock control signal line groups. Input terminals of the X switching element groups 141 of the multiplexer are connected to the data signal output line. The output terminal of each of the X switching element groups 141 is connected to a corresponding data line.

As shown in FIG. 2, when the value of M is 2, the value of N is 3 and the value of X is 6, the multiplexer 14 of the display panel includes six switching element groups 141 in one-to-one correspondence with the six data lines; the display panel further includes six clock control signal line groups, respectively clock control signal line groups CK1 to CK6; and each switching element group 141 corresponds to one clock control signal line group, and the clock control signal line group is electrically connected to the control terminal of the respective switching element group 141 for controlling the turning on and turning off of the respective switching element group 141 by the clock control signal. Moreover, the six switching element groups 141 of the multiplexer 14 correspond to the same data signal output line, and each switching element group 141 has a data line in one-to-one correspondence. The input terminals of the switching element groups 141 are electrically connected to the respective data signal output line. The output terminal of the switching element group 141 is electrically connected to the data line in one-to-one correspondence. When the switching element group 141 is turned on by the clock control signal inputted at the control terminal of the switching element group 141, a data signal, for output by the data line output line, is inputted at the input terminal of the switching element group 141 and is outputted to the respective data line of the switching element group 141 through the output terminal of the switching element group 141. When the switching element group 141 is turned off by the clock control signal inputted at the control terminal of the switching element group 141, the respective data line of the switching element group 141 fails to receive the data signal outputted by the data signal output line. Referring to FIG. 2, the data signal output line may be electrically connected to the source driver 15, and the source driver 15 outputs a clock control signal through a clock control signal group.

Figure 5:
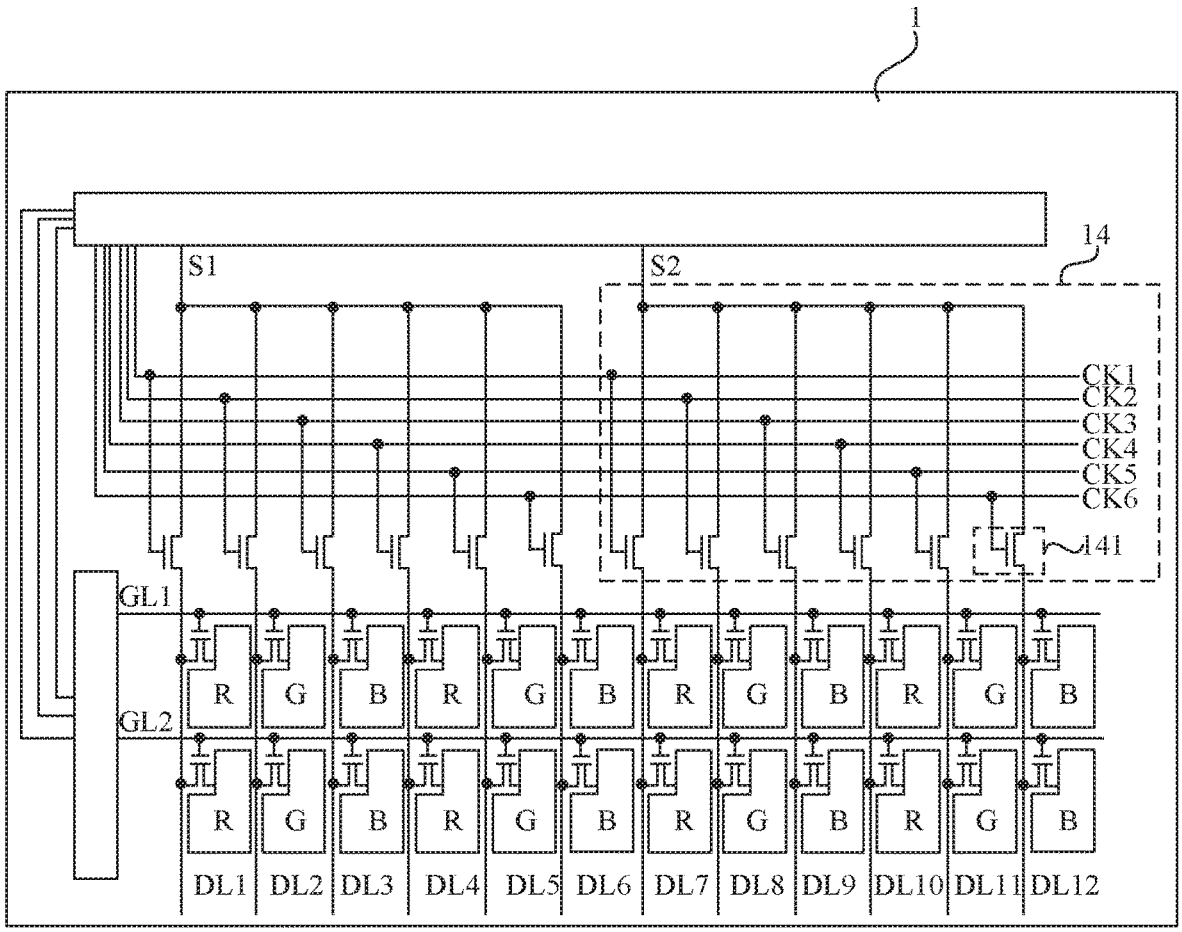
FIG. 5 is a structural diagram of another driving circuit of the display panel according to an embodiment of the present disclosure.

In one embodiment, referring to FIG. 5, FIG. 5 is a structural diagram of another driving circuit of the display panel according to an embodiment of the present disclosure. Each switching element group 141 includes a thin film transistor. The thin film transistor may be a P-type thin film transistor or an N-type thin film transistor. Each clock control signal line group includes a clock control signal line electrically connected to the control terminal of the thin film transistor of the respective switching element group 141.

As shown in FIG. 5, the switching element group 141 includes a thin film transistor, and the clock control signal line group corresponding to the switching element group 141 includes a clock control signal line for controlling the turning on and turning off of the control terminal of the single thin film transistor. If the thin film transistor is the P-type thin film transistor, the thin film transistor is turned on at a low voltage, and the respective clock control signal line outputs a logic low level pulse signal to the control terminal of the thin film transistor. If the thin film transistor is the N-type thin film transistor, the thin film transistor is turned on at a high voltage, and the respective clock control signal line outputs a logic high level pulse signal to the control terminal of the thin film transistor. As shown in FIG. 5, the N-type thin film transistor is taken as an example for description, and the clock control signal outputted by the clock control signal line is the logic high level pulse signal.

Figure 6:
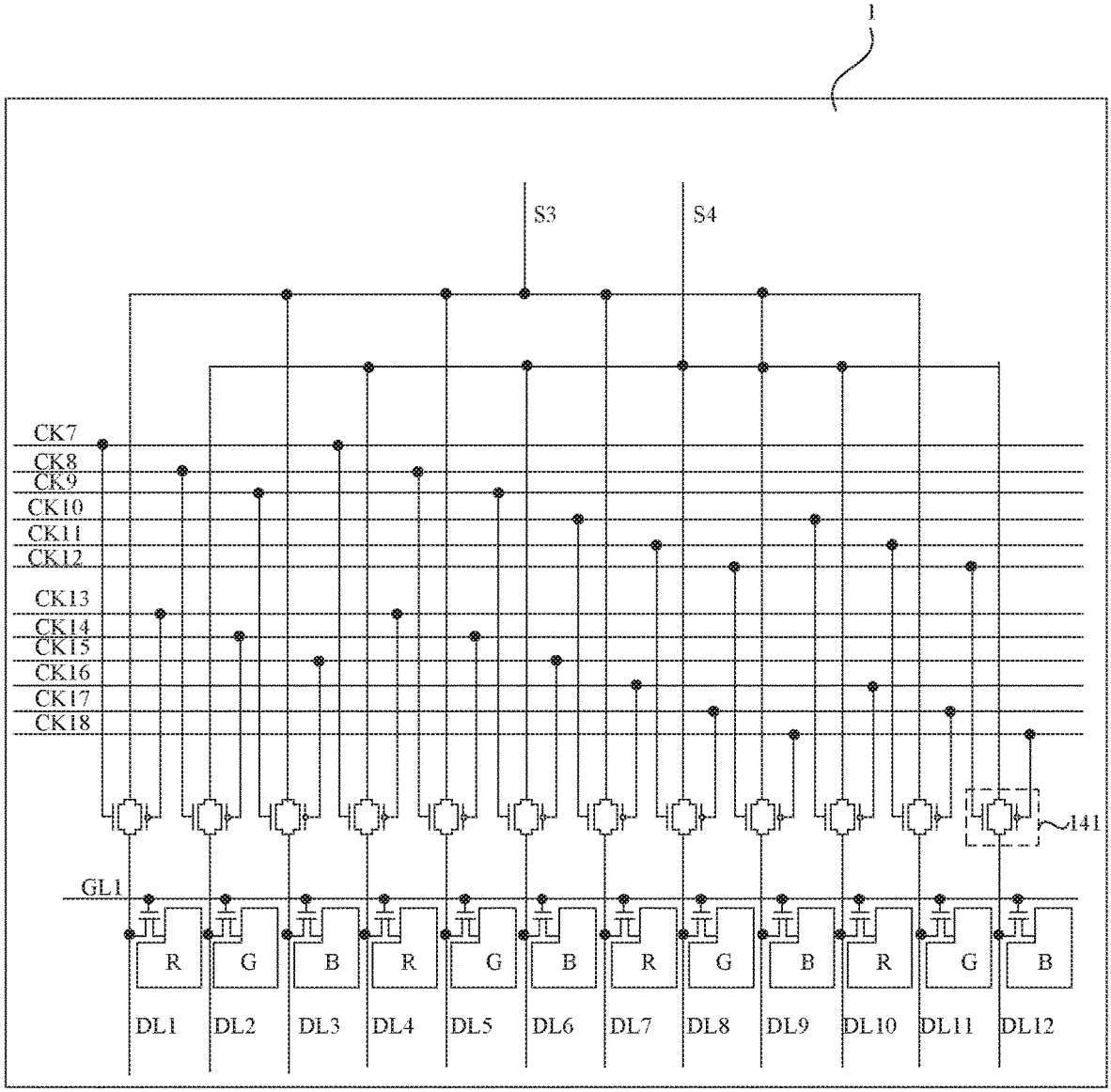
FIG. 6 is a structural diagram of another driving circuit of the display panel according to an embodiment of the present disclosure.

In one embodiment, referring to FIG. 6, FIG. 6 is a structural diagram of another driving circuit of the display panel according to an embodiment of the present disclosure. Each switching element group includes a P-type thin film transistor and an N-type thin film transistor. Each clock control signal line group includes two clock control signal lines. One of the two clock control signal lines is connected to a control terminal of the P-type thin film transistor of the respective switching element group 141, and the other of the two clock control signal lines is connected to a control terminal of the N-type thin film transistor of the respective switching element group 141. Clock control signals outputted by the two clock control signal lines are both enable signals or both non-enable signals.

Figure 7:
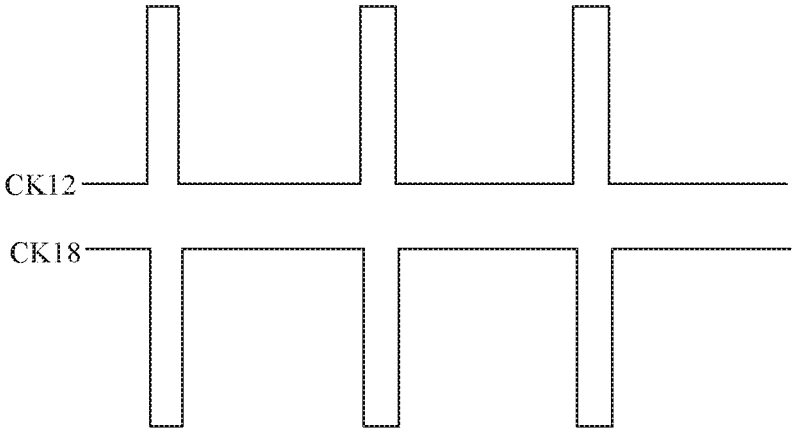
FIG. 7 is a waveform diagram of clock control signals outputted by a clock control signal line CK12 and a clock control signal line CK18 according to an embodiment of the present disclosure.

In condition that each switching element group is provided with a P-type thin film transistor and an N-type thin film transistor, the input terminal of the P-type thin film transistor is electrically connected to the input terminal of the N-type thin film transistor, and the output terminal of the P-type thin film transistor is electrically connected to the output terminal of the N-type thin film transistor, the P-type thin film transistor and the N-type thin film transistor can be controlled to be turned on and turned off at the same time for improving the conduction efficiency of the switching element group 141. A stronger data signal can be received by the data line corresponding to the switching element group 141, and each clock control signal line group needs two clock control signal lines to respectively output clock control signals to the control terminals of the P-type thin film transistor and the N-type thin film transistor. Exemplarily, as shown in FIG. 6, the control terminal of the N-type thin film transistor of the switching element group 141 corresponding to a certain data line DL12 is connected to the clock control signal line CK12, the control terminal of the P-type thin film transistor is connected to the clock control signal line CK18, and the clock control signal line CK12 and the clock control signal line CK18 form a clock control signal group. To ensure the simultaneous turn-on and turn-off of the P-type thin film transistor and the N-type thin film transistor, the clock control signals outputted by the clock control signal line CK12 and the clock control signal line CK18 are both enable signals or both non-enable signals, the enable signal of the clock control signal line CK12 is a logic high level signal, and the enable signal of the clock control signal line CK18 is a logic low level signal. As shown in FIG. 7, FIG. 7 is a waveform diagram of clock control signals outputted from the clock control signal line CK12 and the clock control signal line CK18 according to an embodiment of the present disclosure. The timing of the clock control signal waveforms outputted from the clock control signal line CK12 and the clock control signal line CK18 is the same, while the pulse waveform of the clock control signal outputted by the clock control signal line CK12 is a positive pulse, and the pulse waveform of the clock control signal outputted by the clock control signal line CK18 is a negative pulse.

In addition, a data line group 14 is formed by every X data lines of the plurality of data lines connected to M columns of the pixel units, and the M columns of pixel units may be adjacent M columns of pixel units. As shown in FIG. 5, if each pixel unit includes three sub-pixels, a data line group 14 may be formed by six data lines of the adjacent two columns of pixel units. The M columns of pixel units may be non-adjacent M columns of pixel units, and one or more pixel units may be spaced between each pixel unit. Even, the X columns of sub-pixels corresponding to the X data lines in the data line group 14 are not concentrated in the M columns of pixel units, and the X columns of sub-pixels may form columns of sub-pixels having the same number of columns of sub-pixels included in the M columns of pixel units. Exemplarily, as shown in FIG. 6, if each pixel unit includes three sub-pixels, a data line group 14 may be formed by six data lines of four columns of pixel units. For example, a multiplexer 14 connected to the data signal output line S3 selects two columns of red sub-pixels, two columns of blue sub-pixels and two columns of green sub-pixels from the four columns of pixel units. Similarly, a multiplexer 14 connected to the data signal output line S4 selects six columns of sub-pixels from the four columns of pixel units, and the two multiplexers 14 each correspond to four columns of pixel units.

Figure 8:
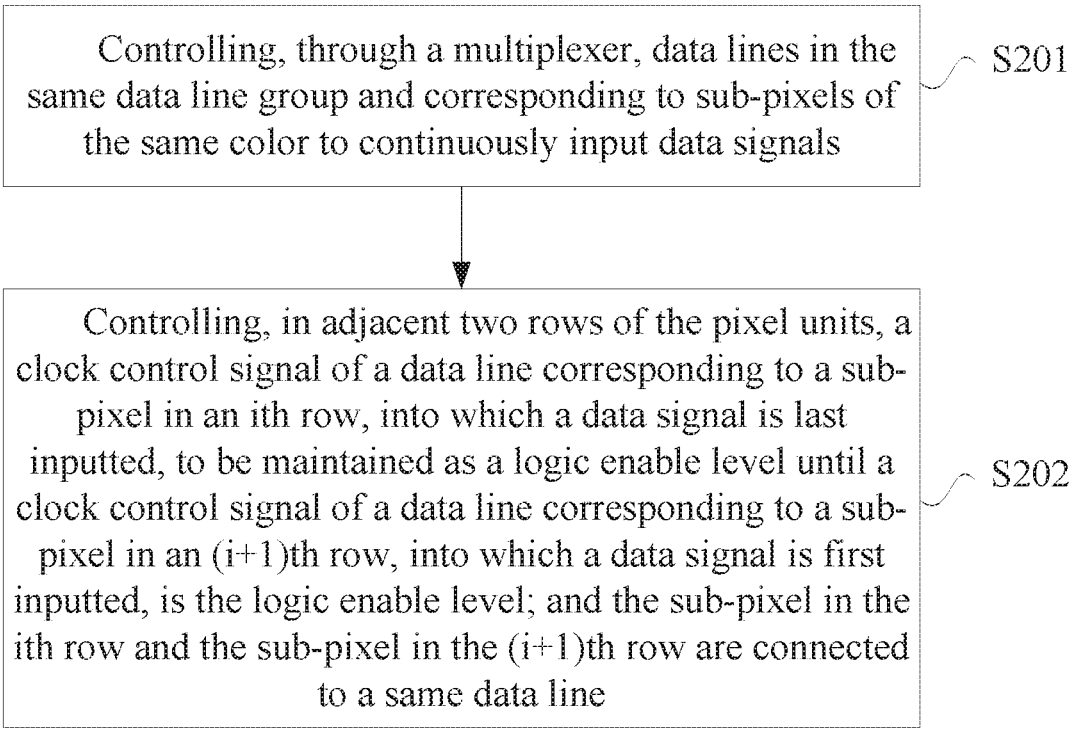
FIG. 8 is a flowchart of another driving method for a display panel according to an embodiment of the present disclosure.

In one embodiment, referring to FIG. 8, FIG. 8 is a flowchart of another driving method for a display panel according to an embodiment of the present disclosure. The method includes the steps described below.

In S101, data lines in the same data line group and corresponding to sub-pixels of the same color are controlled, through the multiplexer, to continuously input data signals.

In S202, in adjacent two rows of the pixel units, a clock control signal of a data line corresponding to a sub-pixel in an ith row, into which a data signal is last inputted, is controlled to be maintained as a logic enable level until a clock control signal of a data line corresponding to a sub-pixel in an (i+1)th row, into which a data signal is first inputted, is the logic enable level; and the sub-pixel in the ith row, into which the data signal is last inputted, is connected to a same data line as the sub-pixel in the (i+1)th row, into which the data signal is first inputted. i is a positive integer.

Figure 9:
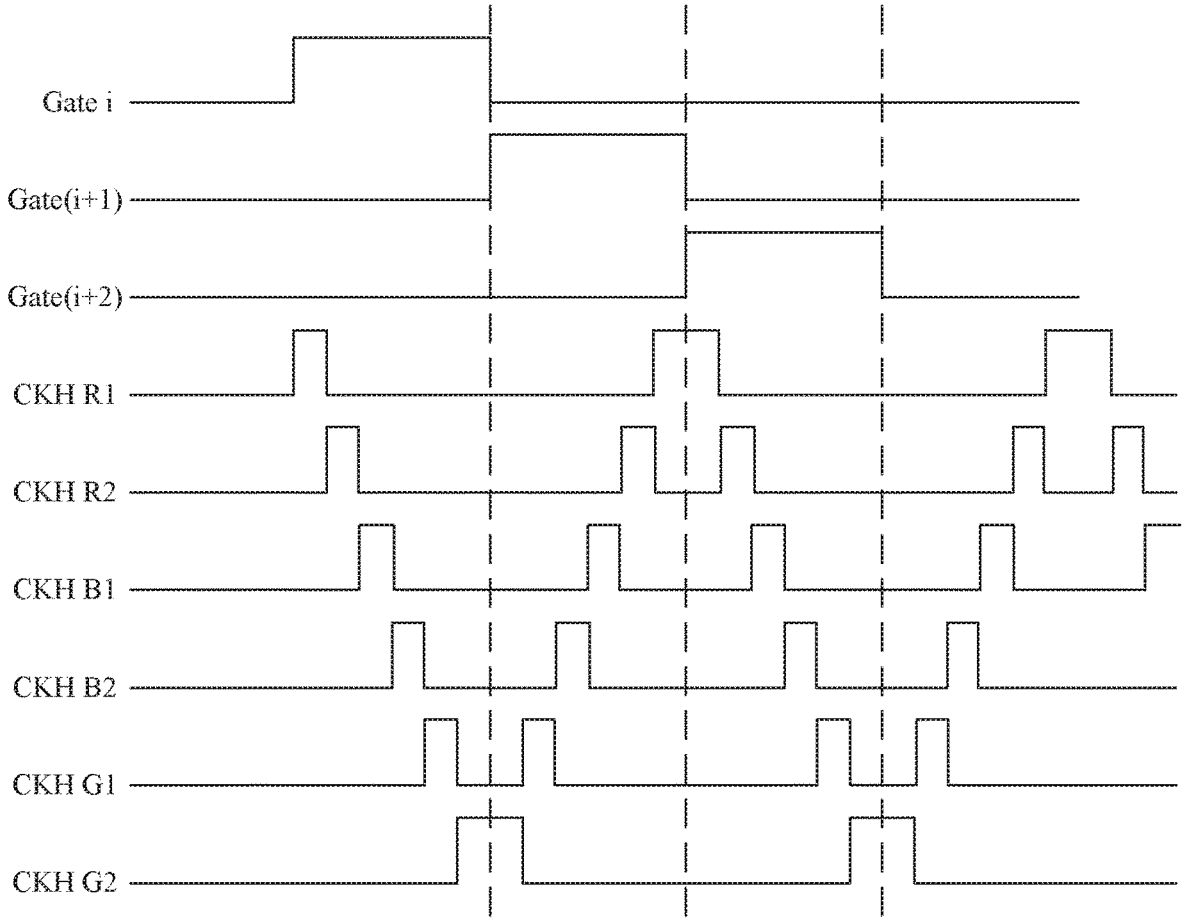
FIG. 9 is another timing diagram of scan signals and clock control signals of the display panel according to an embodiment of the present disclosure.
Figure 10:
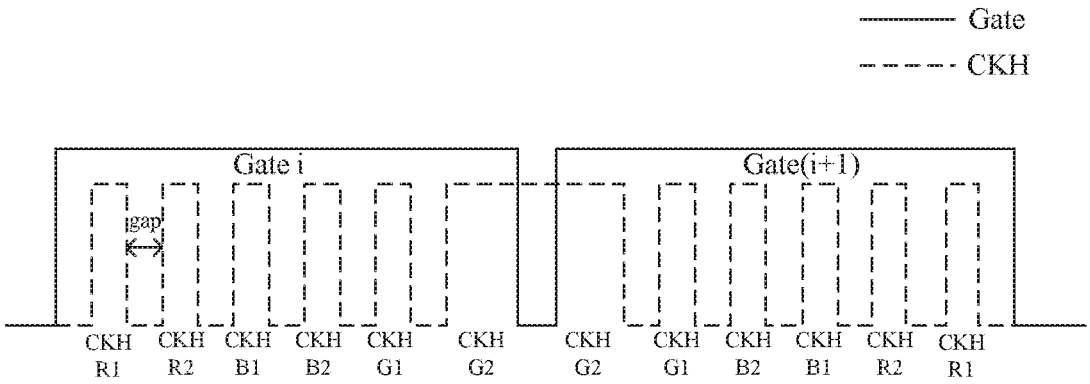
FIG. 10 is a partial view of the scan signals and the clock control signals of FIG. 9 placed in a same timing axis.
Figure 11:
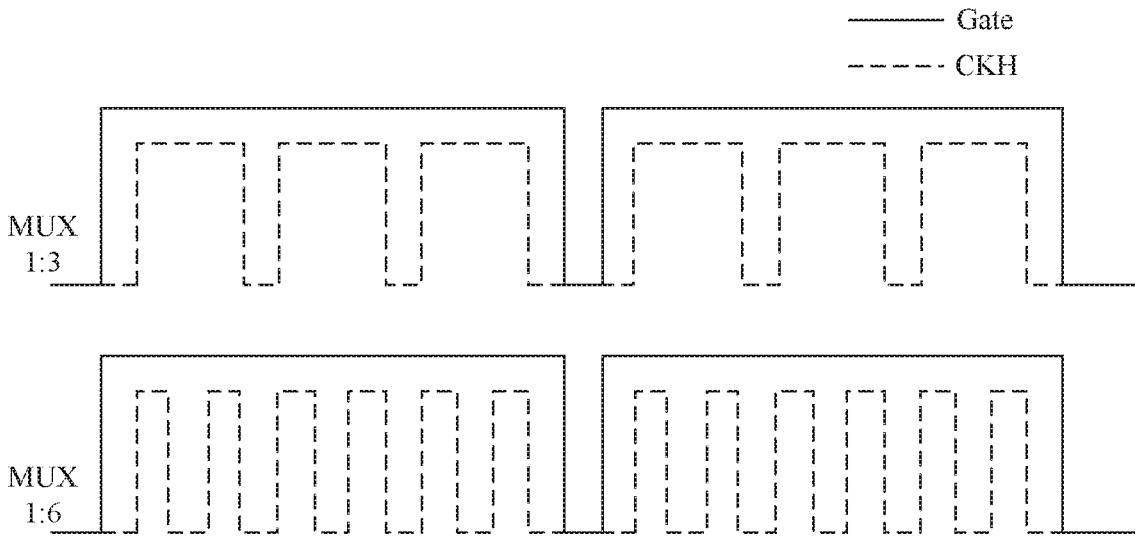
FIG. 11 is a timing diagram of signals of a 1:3 multiplexer and a 1:6 multiplexer in a prior art.

Referring to FIG. 9, FIG. 9 is another timing diagram of display panel scan signals and clock control signals according to an embodiment of the present disclosure. It is assumed that a scanline signal of the ith row of pixel units is Gate i. During the scanning process of the scan line signal Gate i, the clock control signal lines in each clock control signal group control the respective switching element groups to be turned on one by one, and thereby the data signals are inputted to the data lines one by one in each data line group. As shown in FIG. 9, in condition that a pixel unit is formed by three adjacent sub-pixels, a data line group is formed by six data lines of two adjacent columns of pixel units, and only one clock control signal line is included in the clock control signal line group corresponding to the switching element group, the six clock control signal lines respectively output the red sub-pixel clock control signal CKH R1, the red sub-pixel clock control signal CKH R2, the blue sub-pixel clock control signal CKH B1, the blue sub-pixel clock control signal CKH B2, the green sub-pixel clock control signal CKH G1 and the green sub-pixel clock control signal CKH G2. In the scanning process of the scan line signal Gate i, among the six clock control signal lines, the clock control signal that is last turned on by the respective switching element group remains the logic enable level state until the scan line signal Gate(i+1) of the next row of pixel units starts scanning, and during the scanning process of the scanline signal Gate(i+1), the clock control signal line that is first turned on by the respective switching element group is the clock control signal line that is last turned on by the respective switching element group in the scanning process of the scan line signal Gate i. That is, the sub-pixel in the ith row, into which the data signal is last inputted, is connected to the same data line as the sub-pixel in the (i+1)th row, into which the data signal is first inputted. Referring to FIG. 9, exemplarily, in the scanning process of Gate i, in condition that the last clock control signal that becomes the logic enable level state is the green sub-pixel clock control signal CKH G2, the green sub-pixel clock control signal CKH G2 remains the enable state until the scan line signal Gate(i+1) starts scanning, and during the scanning process of Gate(i+1), the green sub-pixel clock control signal CKH G2 is used as the first clock control signal in an enabled state. Referring to FIG. 10, FIG. 10 is a partial view of the scan signals and the clock control signals of FIG. 9 placed in the same timing axis. The scan signals and the red sub-pixel clock control signal CKH R1, the red sub-pixel clock control signal CKH R2, the blue sub-pixel clock control signal CKH B1, the blue sub-pixel clock control signal CKH B2, the green sub-pixel clock control signal CKH G1 and the green sub-pixel clock control signal CKH G2 are added into one time axis, and then it may be seen very intuitively that the green sub-pixel clock control signal CKH G2 spans the scan signal Gate i and the scan signal Gate(i+1), and the energy consumption is high when the clock control signal changes from zero to the logic enable level. In the embodiment, the clock control signal spans the interval between two scan signals, reducing the number of times the clock control signal is inverted, and reducing the power consumption of the clock control signal line. In addition, the clock control signal spans the interval between the scan signals, and then the charging ability of the sub-pixels can be effectively improved. Referring to FIG. 11, FIG. 11 is a timing signal diagram of a 1:3 multiplexer and a 1:6 multiplexer in the related art. Compared with the 1:3 multiplexer, the pulse area of the clock control signal CKH is reduced for the 1:6 multiplexer. Compared with the 1:3 multiplexer, the charging time of the display panel is reduced by half for the 1:6 multiplexer. The display panel is then caused to have a problem of insufficient charging capability, and the display effect of the display panel is poor. In the embodiment, the clock control signal spans the interval between the two scan signals, and the charging capability of the sub-pixel to which the data signal is last inputted is improved to some extent.

In one embodiment, still referring to FIG. 9 and FIG. 10, N=3, and each pixel unit may include the red sub-pixel, the green sub-pixel, and the blue sub-pixel; and among the adjacent two rows of the pixel units, a sub-pixel in an odd-numbered row, into which a data signal is last inputted, is controlled to be the green sub-pixel, and a sub-pixel in an even-numbered row, into which a data signal is last inputted, is controlled to be the red sub-pixel.

Or, N=3, and each pixel unit may include the red sub-pixel, the green sub-pixel, and the blue sub-pixel; and among the adjacent two rows of the pixel units, a sub-pixel in an odd-numbered row, into which a data signal is last inputted, is controlled to be the red sub-pixel, and a sub-pixel in an even-numbered row, into which a data signal is last inputted, is controlled to be the green sub-pixel.

Figure 12:
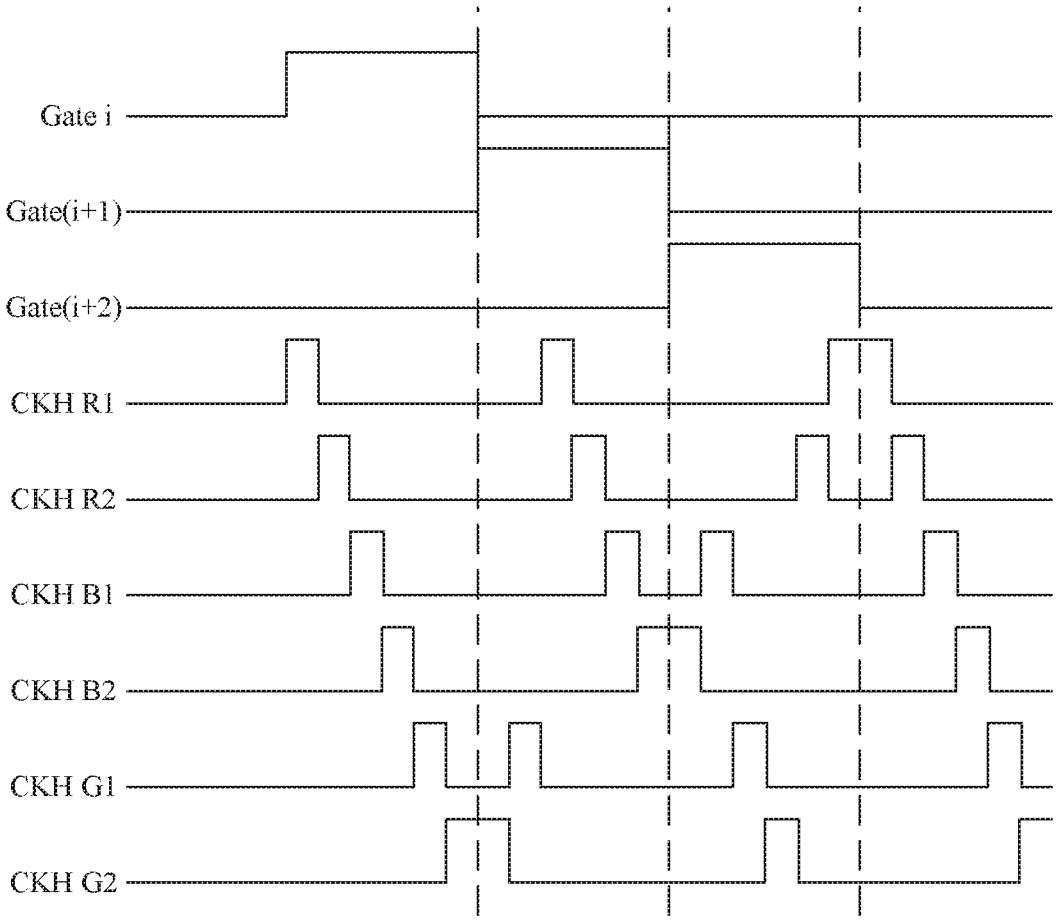
FIG. 12 is another timing diagram of display panel scan signals and clock control signals according to an embodiment of the present disclosure.

Of course, FIG. 9 only shows the case where the data signals are inputted to each row of sub-pixels in a sequence of the red sub-pixel, the blue sub-pixel, and the green sub-pixel, or the green sub-pixel, the blue sub-pixel, and the red sub-pixel. The data signals may also be inputted to each row of the sub-pixels in other sequences. Referring to FIG. 12, FIG. 12 is another timing diagram of display panel scan signals and clock control signals according to an embodiment of the present disclosure. In a case where the ith row of sub-pixels are scanned by the scan signal and the data signals are inputted to the sub-pixels in the sequence of the red sub-pixel, the blue sub-pixel and the green sub-pixel, the clock control signal corresponding to the green sub-pixel remains the enable state until the (i+1)th row of sub-pixels are scanned. In the (i+1)th row, in condition that the data signals are inputted to the sub-pixels in the sequence of the green sub-pixel, the red sub-pixel and the blue sub-pixel, the clock control signal corresponding to the blue sub-pixel remains the enable state until the (i+2)th row of sub-pixels are scanned. In the (i+2)th, in condition that the data signals are inputted to the sub-pixels in the sequence of the blue sub-pixel, the green sub-pixel and the red sub-pixel, the clock control signal corresponding to the red sub-pixel remains the enable state until the (i+3)th row of sub-pixels are scanned. Then, in the display panel driving process shown in FIG. 10, the sub-pixel to which the clock control signal corresponds remains the enable state until the next row is scanned by the scan signal may be the blue sub-pixel, the red sub-pixel, or the green pixel.

In one embodiment, the pulse interval between the first clock control signal and the second clock control signal is 0.05 to 0.2 μs; the first clock control signal is a pulse signal on a clock control signal line of a switching element group to which a data line corresponding to the first sub-pixel is connected; the second clock control signal is a pulse signal on a clock control signal line of a switching element group to which a data line corresponding to the second sub-pixel is connected; and the first sub-pixel and the second sub-pixel are sub-pixels of the same color or of different colors to which the data signals are continuously inputted. Exemplarily, still referring to FIG. 10, if the first clock control signal is the red sub-pixel clock control signal CKH R1, the second clock control signal is the red sub-pixel clock control signal CKH R2, and both the first sub-pixel and the second sub-pixel are red sub-pixels. The pulse interval between the red sub-pixel clock control signal CKH R1 and the red sub-pixel clock control signal CKH R2 is 0.05 to 0.2 μs. Exemplarily, the pulse interval may be 0.1 μs, so that the pulse interval is small, effectively increasing the width of the clock control signal, and increasing the charging time of the display panel. Or, if the first clock control signal is the red sub-pixel clock control signal CKH R2, the second clock control signal is the blue sub-pixel clock control signal CKH B1, and the first sub-pixel is the red sub-pixel, and the second sub-pixel is the blue sub-pixel. The pulse interval between the red sub-pixel clock control signal CKH R2 and the blue sub-pixel clock control signal CKH B1 is 0.05 to 0.2 μs. In one embodiment, the pulse interval between the scan signals Gate i and Gate(i+1) of the adjacent two rows of sub-pixels may also be 0.05 to 0.2 μs.

Figure 13:
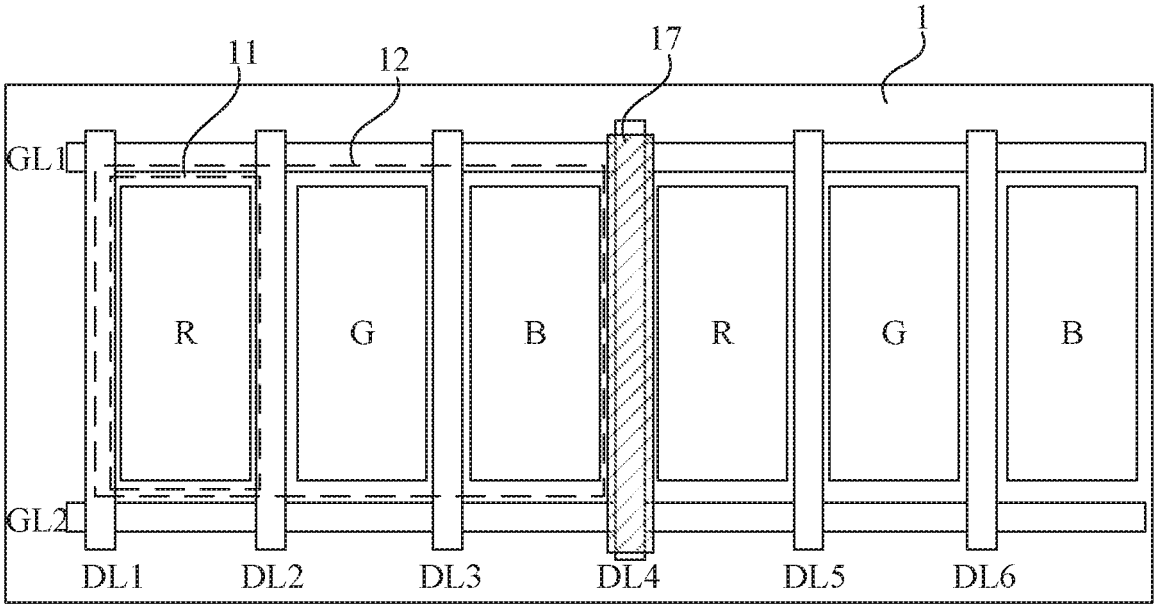
FIG. 13 is a partial structural view of a display panel according to an embodiment of the present disclosure.

Referring to FIG. 13, FIG. 13 is a partial structural view of a display panel according to an embodiment of the present disclosure. The base substrate 1 of the display panel is formed with a plurality of intersected data lines and scanlines, such as scanlines GL1 and GL2 and data lines DL1 and DL2. In one embodiment, N=3, and each pixel unit includes a red sub-pixel, a green sub-pixel and a blue sub-pixel. The display panel may further include a touch trace 17, and a vertical projection of the touch trace 17 on a plane of the base substrate 1 is overlapped at least in part with that of a data line DL4 corresponding to the blue sub-pixel on the plane of the base substrate 1. As shown in FIG. 13, a display unit 12 may include red sub-pixels, green sub-pixels, and blue sub-pixels arranged sequentially in the direction of the scanline. The touch trace 17 may be disposed between the display units 12. The touch trace 17 may be overlapped at least in part with the data line DL4 corresponding to the blue sub-pixel on the plane of the base substrate 1. Exemplarily, the touch trace 17 may be set to have a slightly larger width than the data line DL4.

In one embodiment, M=2, and the larger the value of M, the smaller number of the data signal output lines needs to be set, which is beneficial for simplifying the setting of the display panel driving circuit. The larger the value of M, the less the time for the data signal to be inputted into each sub-pixel, resulting in insufficient charging of the sub-pixel. Therefore, M can take a value of 2, and the 1:6 multiplexer is used to input the data signal to the data line. Thus, the sub-pixel can be ensured to be fully charged and the driving circuit of the display panel can be simplified for setting.

In one embodiment, in adjacent jth and (j+1)th rows of the pixel units, the data signals may be inputted to sub-pixels of the jth row of the pixel units in a sequence of the red sub-pixel, the blue sub-pixel, and the green sub-pixel; and the data signals are inputted to sub-pixels of the (j+1)th row of the pixel units in a sequence of the green sub-pixel, the blue sub-pixel, and the red sub-pixel. j is a positive integer.

Or, in adjacent jth and (j+1)th rows of the pixel units, the data signals may be inputted to sub-pixels of the jth row of the pixel units in a sequence of the green sub-pixel, the blue sub-pixel, and the red sub-pixel; and the data signals are inputted to sub-pixels of the (j+1)th row of the pixel units in a sequence of the red sub-pixel, the blue sub-pixel, and the green sub-pixel. j is a positive integer.

Or, the data signals are inputted to sub-pixels in each row of the pixel units in a sequence of the red sub-pixel, the blue sub-pixel and the green sub-pixel.

The touch trace 17 is overlapped at least in part with the data line corresponding to the blue sub-pixel on the plane of the base substrate 1, so it is necessary to ensure that the blue sub-pixel is not used as the sub-pixel to which the data signal is last inputted among each row of sub-pixels, thereby to avoid the problem that the touch electrodes are visible under the reloaded picture. A touch detection is performed on the touch trace during the time interval of display by the display panel. If the data line partially overlapped with the touch trace is last to input the data signal, coupling capacitance is easy to be generated between the data line and the trace, which affects the display effect of the display panel, and the touch electrodes are easily visible under the reloaded picture. Therefore, the data line partially overlapped with the touch trace needs to be avoided to be the last to input the data signal.

Of course, the touch trace may be partially overlapped with the data line corresponding to the sub-pixel of other colors. For example, the touch trace may be partially overlapped with the data line corresponding to the red sub-pixel, and the red sub-pixel needs to be avoided as the sub-pixel to which the data signal is last inputted.

Figure 14:
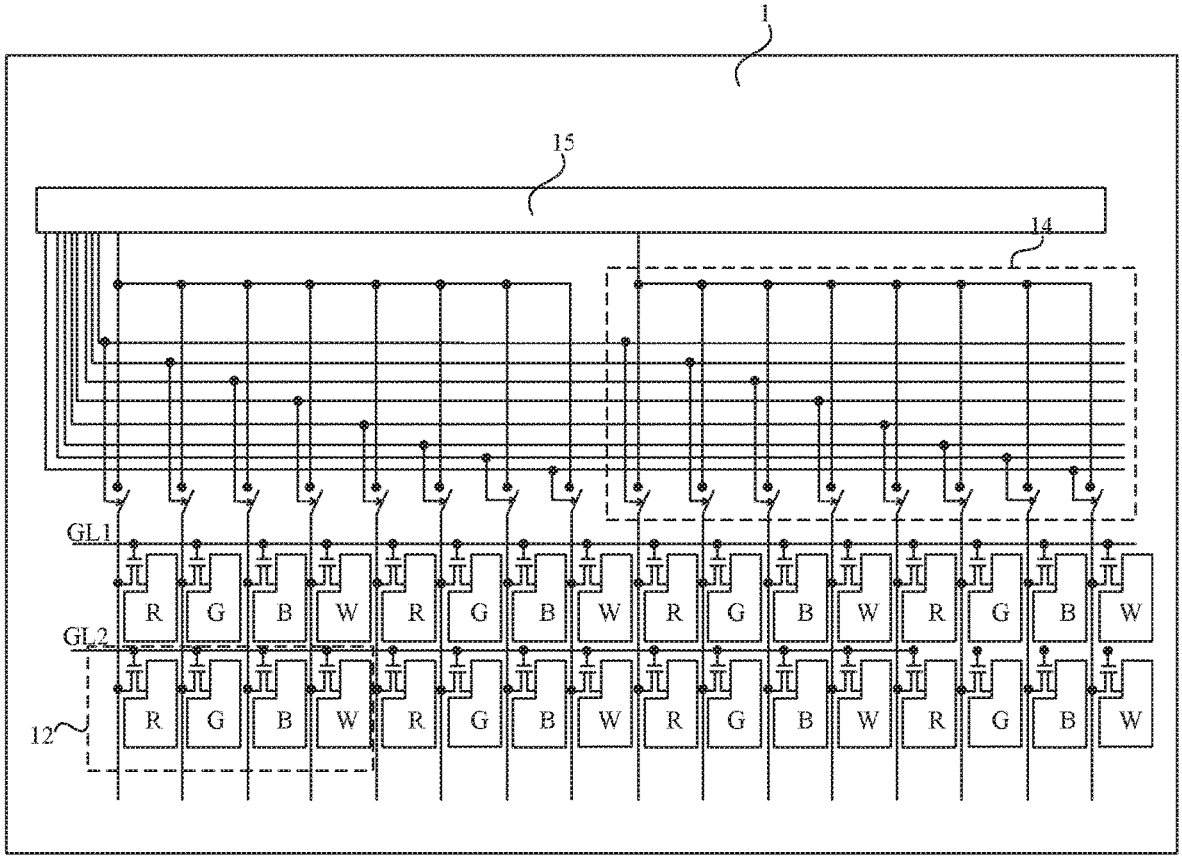
FIG. 14 is a structural diagram of another driving circuit of the display panel according to an embodiment of the present disclosure.

Referring to FIG. 14, FIG. 14 is a structural diagram of another display panel driving circuit according to an embodiment of the present disclosure. In one embodiment, N=4, and each pixel unit 12 includes a red sub-pixel, a green sub-pixel, a blue sub-pixel and a white sub-pixel. The display panel further includes a touch trace, and a vertical projection of the touch trace on a plane of the base substrate is overlapped at least in part with that of a data line corresponding to the white sub-pixel on the plane of the base substrate. Referring to FIG. 14, the pixel unit may include red sub-pixels, green sub-pixels, blue sub-pixels, and white sub-pixels sequentially arranged along the directions of the scanline GL1 and the scanline GL2, and the touch trace is generally disposed at the edge of the pixel unit and is usually partially overlapped with the data line connected to the white sub-pixel. An addition of white sub-pixels on the basis of red sub-pixels, green sub-pixels and blue sub-pixels can increase the transmittance of the screen and increase the display brightness of the display panel, which is beneficial for improving the backlight utilization rate and thus reducing the backlight power.

In one embodiment, M=2. When N=4 and M=2, a data line group 14 is formed by eight data lines connected to two columns of pixel units, and each data line group 14 is connected to a data signal output line through a multiplexer. M takes a value of 2, and a 1:8 multiplexer is used to input the data signal to the data line. Thus, the sub-pixel can be ensured to be fully charged and the driving circuit of the display panel can be simplified for setting.

In one embodiment, in adjacent two rows of the pixel units, a clock control signal of a data line corresponding to a sub-pixel in a kth row, into which a data signal is last inputted, is controlled to be maintained as a logic enable level until a clock control signal of a data line corresponding to a sub-pixel in a (k+1)th row, into which a data signal is first inputted, is the logic enable level; and the sub-pixel in the kth row, into which the data signal is last inputted is connected to a same data line as the sub-pixel in the (k+1)th row, into which the data signal is first inputted. k is a positive integer.

In one embodiment, in adjacent kth and (k+1)th rows of the pixel units, the data signals may be inputted to sub-pixels of the kth row of the pixel units in a sequence of the red sub-pixel, the green sub-pixel, the white sub-pixel and the blue sub-pixel; and the data signals are inputted to sub-pixels of the (k+1)th row of the pixel units in a sequence of the blue sub-pixel, the white sub-pixel, the green sub-pixel and the red sub-pixel. k is a positive integer.

Or, in adjacent kth and (k+1)th rows of the pixel units, the data signals may be inputted to sub-pixels of the kth row of the pixel units in a sequence of the blue sub-pixel, the white sub-pixel, the green sub-pixel and the red sub-pixel; and the data signals may be inputted to sub-pixels of the (k+1)th row of the pixel units in a sequence of the red sub-pixel, the green sub-pixel, the white sub-pixel and the blue sub-pixel. k is a positive integer.

Or, the data signals may be inputted to sub-pixels of each row of the pixel units in a sequence of the red sub-pixel, the green sub-pixel, the white sub-pixel and the blue sub-pixel.

In the embodiment, the order of inputting data signals to each row of sub-pixels is not limited to the above three types, and the order of inputting data signals to the adjacent rows of sub-pixels may be set differently. For example, the data signals may be inputted to sub-pixels of the kth row in a sequence of the red sub-pixel, the white sub-pixel, the green sub-pixel and the blue sub-pixel, the data signals may be inputted to sub-pixels of the (k+1)th row in a sequence of the blue sub-pixel, the white sub-pixel, the green sub-pixel and the red sub-pixel, and the data signals may be inputted to sub-pixels of the (k+2)th row in a sequence of the red sub-pixel, the green sub-pixel, the white sub-pixel and the blue sub-pixel.

In the embodiment, the white sub-pixel cannot be used as the sub-pixel to which the data signal is last inputted among each row of sub-pixels, thereby to avoid the problem that the touch electrodes are visible under the reloaded picture, and to avoid coupling of voltages between the data line connected to the white sub-pixel and the touch trace.

Of course, the touch trace may be partially overlapped with the data line corresponding to the sub-pixel of other colors. For example, the touch trace may be partially overlapped with the data line corresponding to the blue sub-pixel, and the blue sub-pixel needs to be avoided as the sub-pixel to which the data signal is last inputted.

Based on the same concept, an embodiment of the present disclosure further provides a display panel driving circuit. With continue reference to FIG. 2, the driving circuit of the display panel is applicable to the driving method for a display panel provided in any embodiment of the present disclosure. The display panel includes a plurality of data lines and a plurality of scanlines. The plurality of data lines and the plurality of scanlines intersect to define a plurality of sub-pixels. A pixel unit is formed by adjacent N sub-pixels, a data line group is formed by every X data lines of the plurality of data lines connected to M columns of the pixel units, and the driving circuit of the display panel includes a multiplexer. The data line group is connected to a data signal output line through the multiplexer. X=M*N, N is a positive integer greater than or equal to 3, and M is a positive integer greater than or equal to 2. The N sub-pixels in one of the pixel units include a plurality of sub-pixels of different colors.

The driving circuit of the display panel is configured to control, through the multiplexer, data lines in the same data line group and corresponding to sub-pixels of the same color to continuously input data signals.

In one embodiment, referring to FIG. 2, N=3, M=2, and each pixel unit may include a red sub-pixel, a green sub-pixel, and a blue sub-pixel. M takes a value of 2, N takes a value of 3 and a 1:6 multiplexer may be used to input the data signal to the data line. Thus, the sub-pixel can be ensured to be fully charged and the driving circuit of the display panel can be simplified for setting.

In one embodiment, referring to FIG. 14, N=4, M=2, and each pixel unit may include a red sub-pixel, a green sub-pixel, a blue sub-pixel and a white sub-pixel. M takes a value of 2, N takes a value of 4 and the 1:8 multiplexer may be used to input the data signal to the data line. Thus, the sub-pixel can be ensured to be fully charged and the driving circuit of the display panel can be simplified for setting. In addition, the white sub-pixel is included in the pixel unit, and the white sub-pixel has high transmittance rate and high backlight utilization rate. To a certain extent, the power consumption of the display panel can be reduced, and the life time of the display device can be prolonged.

Figure 15:
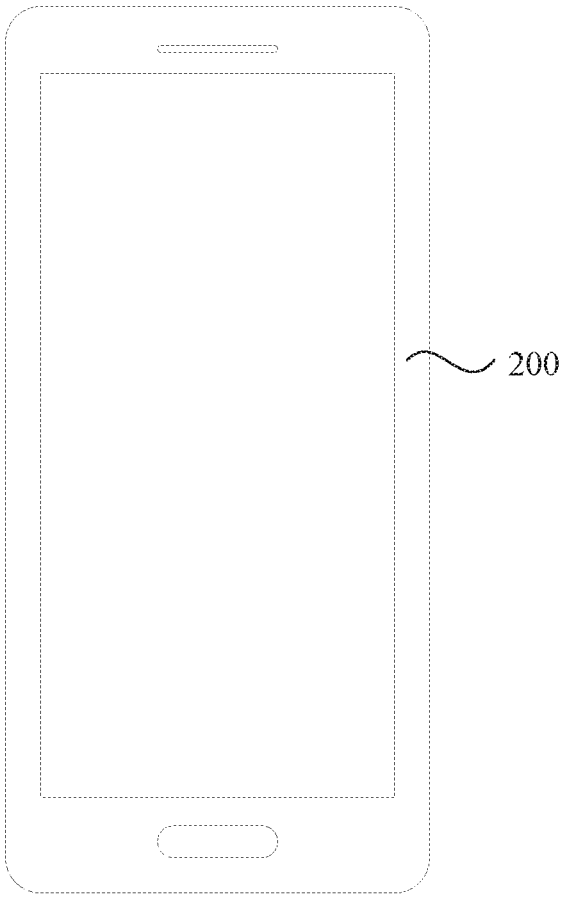
FIG. 15 is a structural diagram of a display device according to an embodiment of the present disclosure.

An embodiment of the present disclosure further provides a display device. FIG. 15 is a structural diagram of the display device according to an embodiment of the present disclosure. As shown in FIG. 15, the display device provided by the embodiment of the present disclosure includes the driving circuit of the display panel according to any embodiment of the present disclosure. The display device may be a mobile phone 200 as shown in FIG. 15, or may be a computer, a television, a smart wearable device, or the like, and is not specifically limited in the embodiment.

What is claimed is:

1. A driving method for a display panel, wherein the display panel comprises a base substrate, a plurality of data lines and a plurality of scanlines; wherein the plurality of data lines and the plurality of scanlines intersect to define a plurality of sub-pixels; wherein each of pixel units is formed by adjacent N sub-pixels, the adjacent N sub-pixels comprise a plurality of sub-pixels of different colors;

wherein N=3, and the each of the pixel units comprises a red sub-pixel, a green sub-pixel and a blue sub-pixel; and wherein the display panel further comprises a touch trace, and a vertical projection of the touch trace on a plane of the base substrate is overlapped at least in part with that of a data line corresponding to the blue sub-pixel on the plane of the base substrate;

the method comprises:

defining every X data lines of the plurality of data lines connected to M columns of the pixel units as a data line group, wherein the data line group is connected to a data signal output line through a multiplexer; wherein X=M*N, N is a positive integer greater than or equal to 3, and M is a positive integer greater than or equal to 2;

controlling, through the multiplexer, data lines in a same data line group and corresponding to sub-pixels of a same color to continuously input data signals.

2. The driving method of claim 1, further comprising:

in adjacent ith and (i+1)th rows of the pixel units, controlling a clock control signal of a data line corresponding to a sub-pixel in the ith row, into which a data signal is last inputted in a scanning process of the ith row of the pixel units, to be maintained as a logic enable level until a clock control signal of a data line corresponding to a sub-pixel in the (i+1)th row, into which a data signal is first inputted in a scanning process of the (i+1) row of the pixel units, is the logic enable level, wherein the sub-pixel in the ith row and the sub-pixel in the (i+1)th row are connected to a same data line, wherein i is a positive integer.

3. The driving method of claim 2, wherein the method further comprises:

in the adjacent ith and (i+1)th rows of the pixel units, controlling a sub-pixel in an odd-numbered row, into which a data signal is last inputted in a scanning process of the odd-numbered row of the pixel units, to be the green sub-pixel, and controlling a sub-pixel in an even-numbered row, into which a data signal is last inputted in a scanning process of the even-numbered row of the pixel units, to be the red sub-pixel.

4. The driving method of claim 2, wherein the method further comprises: in the adjacent ith and (i+1)th rows of the pixel units, controlling a sub-pixel in an odd-numbered row, into which the data signal is last inputted in a scanning process of the odd-numbered row of the pixel units, to be the red sub-pixel, and controlling, a sub-pixel in an even-numbered row, into which the data signal is last inputted in a scanning process of the even-numbered row of the pixel units, to be the green sub-pixel.

5. The driving method of claim 1, wherein the method further comprises:

in adjacent jth and (j+1)th rows of the pixel units, inputting the data signals to sub-pixels of the jth row of the pixel units in a sequence of the red sub-pixel, the blue sub-pixel, and the green sub-pixel; and inputting the data signals to sub-pixels of the (j+1)th row of the pixel units in a sequence of the green sub-pixel, the blue sub-pixel, and the red sub-pixel; wherein j is a positive integer.

6. The driving method of claim 1, wherein the method further comprises:

in adjacent jth and (j+1)th rows of the pixel units, inputting the data signals to sub-pixels of the jth row of the pixel units in a sequence of the green sub-pixel, the blue sub-pixel, and inputting the red sub-pixel; and the data signals to sub-pixels of the (j+1)th row of the pixel units in a sequence of the red sub-pixel, the blue sub-pixel, and the green sub-pixel; wherein j is a positive integer.

7. The driving method of claim 1, wherein the method further comprises:

inputting the data signals to sub-pixels in each row of the pixel units in a sequence of the red sub-pixel, the blue sub-pixel and the green sub-pixel.

8. A display panel, comprising: a plurality of data lines, a plurality of scanlines; wherein the plurality of data lines and the plurality of scanlines intersect to define a plurality of sub-pixels;

wherein each of pixel units is formed by adjacent N sub-pixels, a data line group is formed by every X data lines of the plurality of data lines connected to M columns of the pixel units, and a driving circuit comprises a multiplexer; the data line group is connected to a data signal output line through the multiplexer; wherein X=M*N, N is a positive integer greater than or equal to 3, and M is a positive integer greater than or equal to 2; wherein the N sub-pixels in one of the pixel units comprise a plurality of sub-pixels of different colors;

wherein N=3, and the each of the pixel units comprises a red sub-pixel, a green sub-pixel and a blue sub-pixel;

wherein the display panel further comprises a touch trace, and a vertical projection of the touch trace on a plane of the base substrate is overlapped at least in part with that of a data line corresponding to the blue sub-pixel on the plane of the base substrate; and wherein the driving circuit is configured to control, through the multiplexer, data lines in a same data line group and corresponding to sub-pixels of a same color to continuously input data signals.

9. A display device, comprising the display panel of claim 8.

10. A driving method for a display panel, wherein the display panel comprises a base substrate, a plurality of data lines and a plurality of scanlines; wherein the plurality of data lines and the plurality of scanlines intersect to define a plurality of sub-pixels; wherein each of pixel units is formed by adjacent N sub-pixels, the adjacent N sub-pixels comprise a plurality of sub-pixels of different colors;

wherein N=4, and the each of the pixel units comprises a red sub-pixel, a green sub-pixel and a blue sub-pixel and a white sub-pixel; and wherein the display panel further comprises a touch trace, and a vertical projection of the touch trace on a plane of the base substrate is overlapped at least in part with that of a data line corresponding to the white sub-pixel on the plane of the base substrate the method comprises:

defining every X data lines of the plurality of data lines connected to M columns of the pixel units as a data line group, wherein the data line group is connected to a data signal output line through a multiplexer; wherein X=M*N, N is a positive integer greater than or equal to 3, and M is a positive integer greater than or equal to 2;

controlling, through the multiplexer, data lines in a same data line group and corresponding to sub-pixels of a same color to continuously input data signals.

11. The driving method of claim 10, wherein the method further comprises:

in adjacent kth and (k+1)th rows of the pixel units, inputting the data signals to sub-pixels of the kth row of the pixel units in a sequence of the red sub-pixel, the green sub-pixel, the white sub-pixel and the blue sub-pixel; and inputting the data signals to sub-pixels of the (k+1)th row of the pixel units in a sequence of the blue sub-pixel, the white sub-pixel, the green sub-pixel and the red sub-pixel; wherein k is a positive integer.

12. The driving method of claim 10, wherein the method further comprises:

in adjacent kth and (k+1)th rows of the pixel units, inputting the data signals to sub-pixels of the kth row of the pixel units in a sequence of the blue sub-pixel, the white sub-pixel, the green sub-pixel and the red sub-pixel; and inputting the data signals to sub-pixels of the (k+1)th row of the pixel units in a sequence of the red sub-pixel, the green sub-pixel, the white sub-pixel and the blue sub-pixel; wherein k is a positive integer.

13. The driving method of claim 10, wherein the data signals are inputted to sub-pixels of each row of the pixel units in a sequence of the red sub-pixel, the green sub-pixel, the white sub-pixel and the blue sub-pixel.

* * * * *